US007072727B1

(12) United States Patent
Davis

(10) Patent No.: US 7,072,727 B1
(45) Date of Patent: Jul. 4, 2006

(54) METHOD AND SYSTEM FOR DETERMINING HEAT LOSS OF A BUILDING AND SIZING HVAC EQUIPMENT

(76) Inventor: Tom G. Davis, P.O. Box 1405, El Prado, NM (US) 87529

( * ) Notice: Subject to any disclaimer, the term of this patent is extended or adjusted under 35 U.S.C. 154(b) by 278 days.

(21) Appl. No.: 10/320,146

(22) Filed: Dec. 16, 2002

(51) Int. Cl.
*G06F 19/00* (2006.01)

(52) U.S. Cl. ..... 700/97; 700/209; 700/276

(58) Field of Classification Search ..... 700/97, 700/117, 276–278, 209–210; 379/102.05; 165/200–303; 236/1
See application file for complete search history.

(56) References Cited

U.S. PATENT DOCUMENTS

| | | | | |
|---|---|---|---|---|
| 4,621,528 | A | 11/1986 | Alt et al. | |
| 5,197,666 | A * | 3/1993 | Wedekind | 236/46 R |
| 5,988,517 | A * | 11/1999 | Bauer et al. | 236/49.3 |
| 6,062,482 | A * | 5/2000 | Gauthier et al. | 236/11 |
| 6,651,037 | B1 * | 11/2003 | Hall et al. | 703/8 |
| 6,701,725 | B1 * | 3/2004 | Rossi et al. | 62/125 |

OTHER PUBLICATIONS

"Residential Load Calculation Manual", Air Conditioning Contracting of America (ACCA) Manual J, Seventh Edition.
"Heat Loss Calculation Guide" H-22, Hydronics Institute Division of GAMA, 1998.
"Hydronics Institute Division of GAMA" Oct. 4, 1999 Revision Jan. 10, 1999 to Hydronics Institute H-22 (1998); "Heat Loss Worksheet For Guide H-22" Revision Jan. 10, 1999, 1 page.
"Figures Don't Lie", By Denny Adelman, Hydronics Systems Designer, Contractor—1991, p. 46.
"Estimate of Residential Design Heat Loss" Nebraska 1992, pp. 1-4.
"Worksheet for Manual.J" Load Calculations for Residential Air Conditioning, ACCA 1996.
Benefits of Computerized HVAC Load Calculations, by Bill Smith, Presient of Elite Software, 1998, pp. 1-5.
"Oversized Boilers Are a Big Problem", FOCUS/Residential Boilers, Air Conditioning, Heating & Refrigeration News, May 28, 2001, p. 16.
"Right-Suite™ Training" Training Registration Form—2001.
Wrightsoft Product Catalog "Automated Commercial & Residential HVAC Design" 2001.
"The Right News™" Free Automated Duck Takeoff Upgrade Released for Right-Suite Residential, Wrightsoft Corporation, Fall 2001.
"The Right-News™", Manual J Eight Released, AACA, Wrightsoft Corporation, Spring 2002.
Wrightsoft Faxable Order Form, ACCA.

* cited by examiner

*Primary Examiner*—Zoila Cabrera
(74) *Attorney, Agent, or Firm*—McKee, Voorhees & Sease, P.L.C.

(57) ABSTRACT

A method for determining proper size of HVAC equipment, recording on and off cycling data associated with equipment within a structure for a period of time, recording inside temperature data of the structure for the period of time, recording outside temperature data outside of the structure for the period of time, and determining a minimum size of the HVAC equipment needed to maintain a desired internal temperature at least partially based on an outdoor design temperature, the on and off cycling data, the inside temperature data and the outside temperature data. The present invention also provides for a system of determining the proper size of the HVAC equipment.

16 Claims, 4 Drawing Sheets

METHOD AND SYSTEM FOR DETERMINING HEAT LOSS OF A BUILDING AND SIZING HVAC EQUIPMENT

FIELD OF THE INVENTION

This invention relates to a method of and system for determining the heating or cooling needed to maintain a building's internal temperature for a given outdoor temperature. More specifically the present invention relates to measuring the performance of and sizing the HVAC equipment.

BACKGROUND OF THE INVENTION

The background of the invention is discussed in relationship to one specific application of the invention—sizing of furnaces in residential and small commercial buildings. The present invention is not, however, limited to this specific application. This specific application is merely one example of the larger problem of properly sizing HVAC equipment. Many residential and small commercial buildings contain oversized furnaces and boilers. Due to low profit margins, many contractors merely guess the size of needed heating equipment. In the residential market, 85% of heating equipment is grossly (double correct size) oversized, 5% is undersized and only 10% is close to the designed heat loss of the structure. In contrast, the budget for heating, ventilation and air-conditioning (HVAC) in large buildings allows for more accurate studies of the heat loss and gain of the structure. Therefore, correctly sized equipment is usually found in these larger projects.

One significant, but generally overlooked, problem in residential furnace installations is oversized furnaces installed in undersized duct systems. An oversized furnace has many problems. In particular an oversized furnace will have a lower efficiency, require more maintenance, have a shorter lifetime and provide less comfort to an occupant.

An oversized furnace will cycle on and off quickly. The oversized furnace is able to blow hot air into the space being heated very rapidly in order to increase the temperature to the temperature level set by the thermostat. Most (oversized) furnaces installed in homes today are only on for 4 to 8 minutes at a time. In contrast, a correctly sized furnace will have burner on times of 15 to 16 minutes. This difference in burner on times is significant.

Rapid burner cycling dramatically shortens the life of the heat exchanger in the furnace, usually by 20 to 50 percent. Every time the burners switch on, the heat exchanger expands. Every time the burners switch off, the heat exchanger contracts. This constant expansion and contraction cycling can damage the heat exchanger over time. Because of the rapid cycling of an oversized furnace, the life of the heat exchanger is lessened.

This detrimental flexing of the heat exchanger metal is further exacerbated if the duct system is too small or restricted and the limit switch of the furnace adds yet another on and off cycle. Heat exchanger failures occur on equipment as new as 4–6 years old, although the heat exchangers were intended and expected to remain operational for a significantly longer period of time.

The rapid cycling of oversized equipment also negatively affects the chimney/vent. The furnace is not on long enough to raise the chimney temperature above the vaporization temperature of the flue products. The condensate produced by low chimney temperatures is acidic and can quickly destroy the vent. Even some grades of stainless steel fail when exposed to this condensation. Thus, improper furnace size creates significant problems.

Installing an oversized furnace may also result in a mismatch with the existing duct system. A new furnace generally has a lower temperature rise rating than the replaced furnace. In other words, the new furnace needs a larger volume of air forced through the duct system if the output BTUH (British thermal unit per hour) rating is the same. Some new furnaces actually need double the CFM (cubic feet per minute) as the replaced furnace. Very few duct systems will allow these dramatically increased air flows to happen. Adding a big blower may provide the necessary air volumes, but at the expense of high noise and lower comfort levels. A properly sized new furnace, with its lower air requirements, is more likely to fit with the existing duct system.

An oversized furnace costs more in installation and equipment costs than a properly sized smaller furnace. Furthermore, a properly sized furnace increases comfort levels throughout the home because the heat is provided at a lower, slower level. The occupants are unaware of the furnace cycles. This higher level of comfort often allows occupants to lower the thermostat a degree or two without any problems, saving more energy.

Problems with oversizing of furnaces are particularly noticeable with two-speed or variable speed furnaces. The primary advantages of variable speed furnaces include smooth, quiet and longer heat cycles, when operating on the low input setting. These furnaces still having the capacity to operate at a high stage if colder temperatures demand it. When operating at low speed, a variable speed furnace can provide longer heating cycles which allow for more even floor to ceiling temperatures, less room-to-room temperature difference and therefore more comfort to the home occupants. These advantages of two-speed furnaces are not achieved if the furnace is sized incorrectly such that the high stage of the furnace is never actually initiated, and the cycles of the low stage are too short.

The HVAC industry has attempted to solve this problem. The industry standard for sizing a furnace to be installed in a residence is Manual J, "Residential Load Calculation," by the Air Conditioning Contractors of America, herein incorporated by reference in its entirety. This methodology can take the form of a computer program that does the heat loss calculations using built in formulas, or it can be done manually with a long form that requires the contractor to do the calculations. Both options require the contractor to take measurements of the windows, doors and exposed surface areas of the home. One significant problem with this approach is the lack of knowledge of just how much insulation is in the wall, ceiling or floor. In addition, the rate of infiltration allowed by the building envelope is unknown. Manual J has some excess built-in to make up for these unknowns, resulting in a larger furnace than necessary. In new homes, where insulation and infiltration amounts are known, Manual J still errs on the large side. Manual J is not a load calculation. At best, it is a load estimate. Further, contractors are discouraged from using Manual J due to the number of measurements that must be taken and the complexity of the calculations that must be made. Therefore problems remain.

U.S. Pat. No. 4,621,528 to Alt et al discloses a monitor apparatus and method of determining appliance size. In Alt, a total time and a total furnace on time are recorded. This information is combined with outside temperature, inside temperature, and an outside design temperature to calculate appliance size. One of the problems with Alt relates to accuracy. In particular, instead of looking at on/off cycling, only total on times and total off times are examined and average temperatures are used. Due to temperature fluctuations over the course of an evening and fluctuations in furnace on time, this methodology is inaccurate. In addition, Alt requires all complex calculations to be performed by hand which can be laborious and introduces the opportunity for errors. Further, Alt requires that outdoor temperature either be manually monitored or obtained after the fact from the National Weather Service which is time consuming and not necessarily accurate if the outdoor temperature is taken at a location with a different temperature than immediately outside of the structure. Furthermore, the Alt method is simply impractical for a contractor, HVAC service person, or other professional to perform for an occupied home in a manner that would ensure that they received accurate data. Either the professional would need to be present late at night and early in the morning or else the professional would need to rely upon the occupants to start the device and stop the device at the proper time. This requires the professional to rely too heavily on the occupants. Alt does not provide for ensuring the capture of an entire cycle. Also, in Alt, inaccuracies would also result if the house temperature was higher than the thermostat temperature when the AH clock began. Also, Alt would be particularly inaccurate at high temperatures. Therefore significant problems remain.

In summary, there is a need to provide an accurate and less-time consuming method and system for sizing HVAC equipment.

It is therefore a primary object, feature, or advantage of the present invention to improve over the state of the art.

Another object, feature, or advantage of this invention is to provide a method and system of measuring the actual heat loss of a home/structure.

A further object, feature, or advantage of the present invention is to provide a method and system for properly selecting a furnace to fit a home/structure.

A still further object, feature, or advantage of the present invention is to increase comfort levels of occupants of a home/structure.

Another object, feature, or advantage of the present invention is to save energy.

Yet another object, feature, or advantage of the present invention is to save money in HVAC equipment purchase and maintenance costs.

A further object, feature, or advantage of the present invention is to provide a method and system for sizing HVAC equipment that can be used to identify false cycling.

A still further object, feature, or advantage of the present invention is to provide a method and system for sizing HVAC equipment that is convenient enough and sufficiently reliable and accurate that it can be used for regulation and code enforcement of HVAC installations.

Another object, feature, or advantage of this invention is to provide a method and system of measuring the actual heat loss of a home/structure such that the effect of improvements such as installation of insulation, replacement windows and doors can be quantified.

At least one of these and/or other objects, features and/or advantages of the present invention will become apparent from the specification and claims that follow.

SUMMARY OF THE INVENTION

According to one aspect of the present invention, a method for determining proper size of HVAC equipment is provided. The method includes recording state or on and off cycling data associated with the HVAC equipment within a structure for a period of time. Also, it includes recording inside temperature data of the structure for the period of time and recording outside temperature data outside of the structure for the period of time. The invention also provides for determining a minimum size of the HVAC equipment needed to maintain a desired internal temperature at least partially based on an outdoor design temperature, the on and off cycling data, the inside temperature data, and the outside temperature data.

According to another aspect of the present invention, a system for determining proper size of HVAC equipment is provided. The system includes a first data logger for recording on and off cycling or state data associated with the HVAC equipment within a structure. The system also includes a second data logger for recording outside temperature data outside of the structure. The system also includes an article of software adapted to determine a minimum of the HVAC equipment needed to maintain a desired internal temperature at least partially based on an outdoor design temperature, the on and off cycling data, and the outside temperature data.

DETAILED DESCRIPTION OF THE PREFERED EMBODIMENT

The present invention provides a method and system for measuring heating or cooling needed to maintain a buildings internal temperature for a given outdoor temperature. In a preferred embodiment of the present invention, a method and system for sizing furnaces is provided. The present invention is not to be limited to the preferred embodiment, as the present invention contemplates use in cooling as well as heating.

Figure 1:
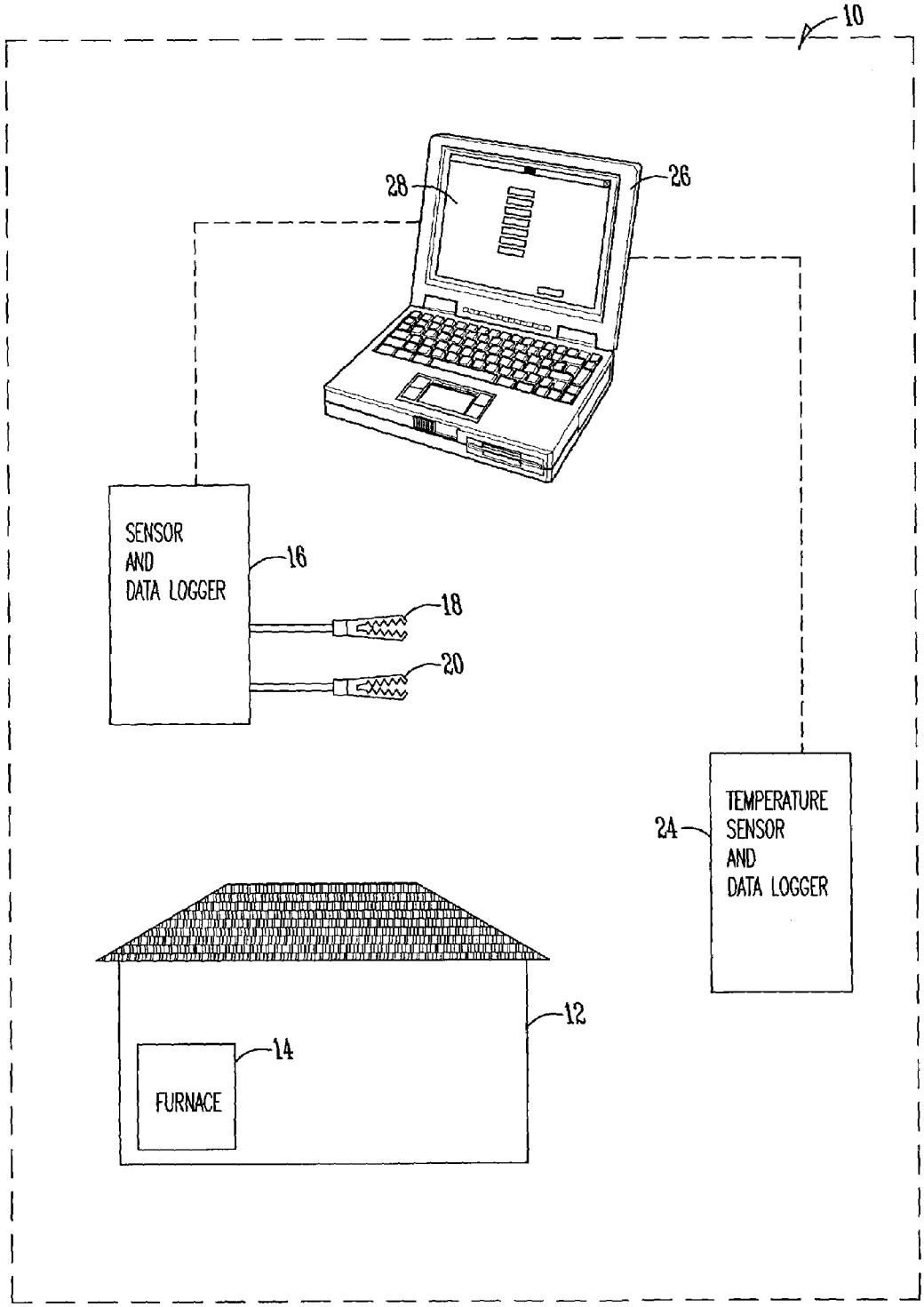
FIG. 1 is a pictorial representation of a system according of one embodiment of the present invention.

FIG. 1 illustrates a pictorial representation of a system according to the present invention. In FIG. 1, the system 10 includes a structure 12 such as a home or other residential building or a small commercial building. Within the structure 12 is HVAC equipment that can include a furnace 14. The furnace 14 is used to produce heat to increase the inside temperature of the structure 12 above an outside temperature. A data logger 16 with attachment leads 18 and 20 is shown. The data logger 16 includes a state sensor. The data logger 16 is electrically connected to the furnace 14 through use of the leads 18 and 20. The data logger 16 includes a relay or other type of isolation circuitry due to differences in the voltage level of the HVAC equipment and the data logger. The data logger 16 can be a HOBO data logger unit from Onset Computer Corporation or can be a data logger from other manufacturers. Preferably, the data logger 16 includes a clock so that not only the changes in state can be recorded, but also a time and or date stamp of when the furnace 14 turns off or on is recorded. The data logger provides a memory or other means to store the data collected. This memory can be a nonvolatile EEPROM memory or other type of memory.

In addition, there is a temperature sensor and data logger 24. The data logger 24 can be a HOBO unit available from Onset Computer Corporation or other temperature sensor or data logger. Preferably, the data logger 24 time stamps each piece of temperature data. The data logger 24 can be used to measure outside or outdoor temperature with respect to the structure 12. Although not shown, another data logger can be used to record indoor temperature, but this is not needed if the indoor temperature is maintained at a known constant temperature. The indoor temperature can be maintained at a known constant temperature if an accurate thermostat is used. It is noted that electronic thermostats may not necessarily provide a constant temperature because they sometimes anticipate temperature changes instead of merely monitoring temperature changes and acting as a switch. Therefore, it is preferred that electronic thermostats are avoided. Instead, the electronic thermostat can be temporarily replaced with a conventional bi-metal thermostat. Alternatively, other types of temperature switches such as non-adjustable thermostats such as TEMP-STAT devices available from Jackson Systems, LLC.

The present invention can be used in conjunction with a variable speed furnace. This can be achieved by locking out the higher speed on the furnace to ensure only low speed operation. Alternatively, one of the thermostats can be removed. Also, a separate data logger can be attached to each stage of the furnace.

A computer 26 is shown upon which an article of software 28 is executed. The article of software 28 is adapted to use off/on or state cycling information from the data logger 16 along with outside temperature sensor information from the data logger 24. The article of software 28 can be adapted to download the data from each data logger through a serial connection or can retrieve data that has been previously stored. In addition, indoor temperature information, such as that which is available from a thermostat or that which can be recorded with a separate data logger of the same general type as data logger 24 can be used.

The present invention uses data loggers to record the state (whether on or off) of a furnace and also the external temperature. This information, along with the internal temperature of the structure and the output and efficiency of the furnace, and the outdoor design temperature associated with the geographic region in which the structure is located, provides the data used to calculate the proper size for the furnace. Preferably, these calculations are made by an article of software executed by a computer.

Figure 2:
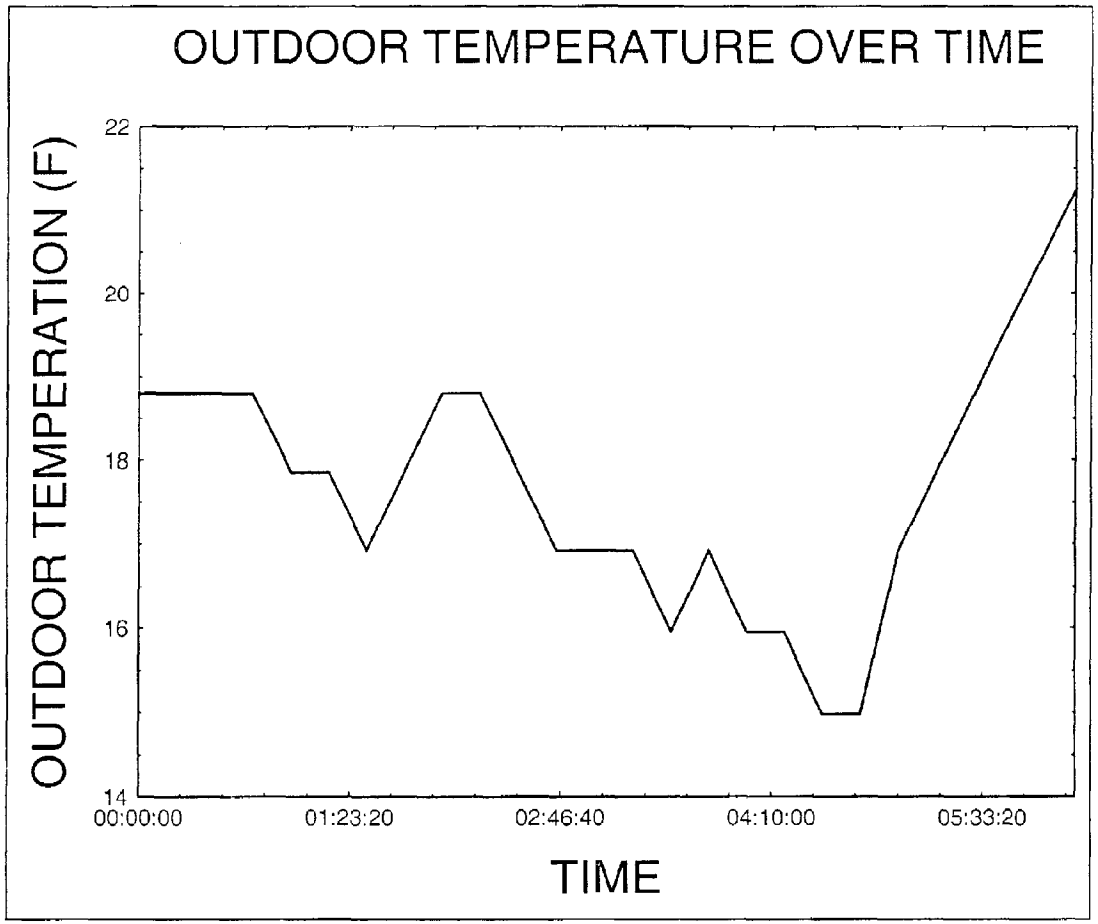
FIG. 2 is a chart showing outside temperature data over time such as can be recorded by a data logger according to one aspect of the invention.
Figure 3:
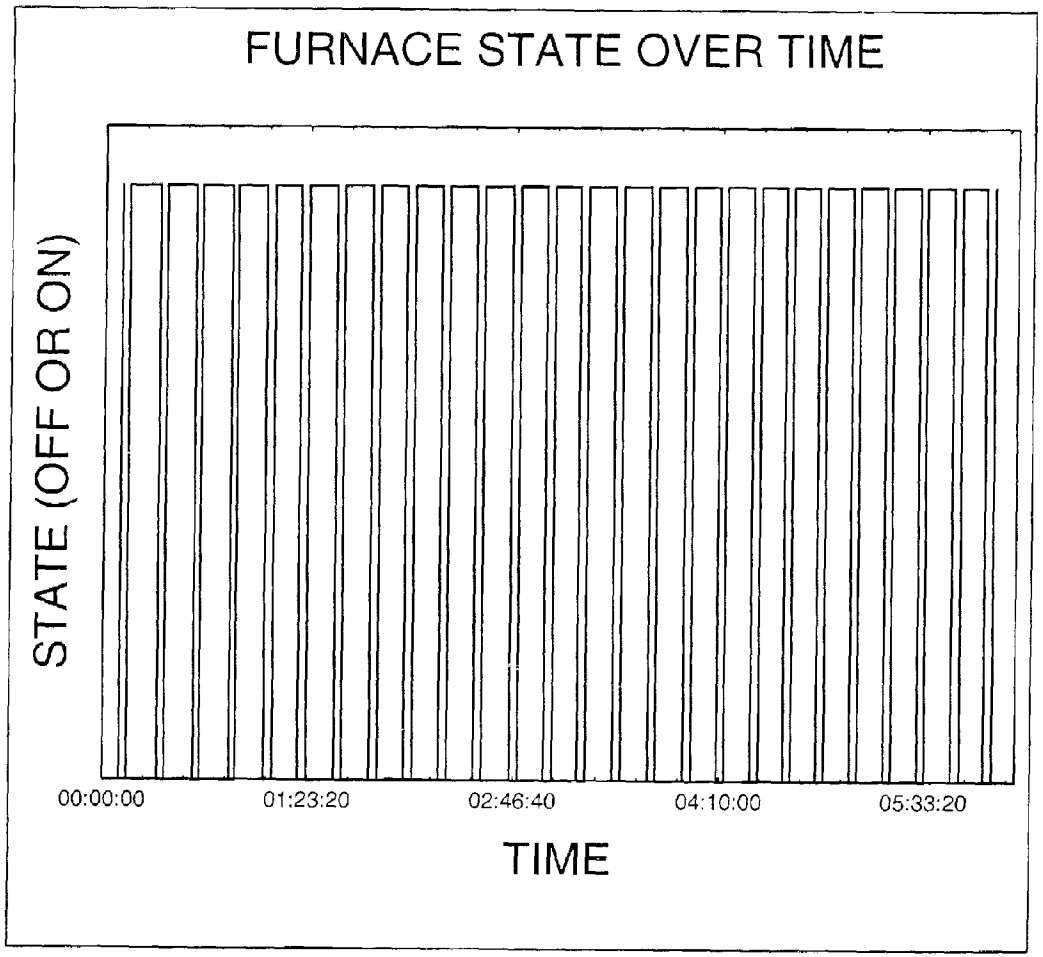
FIG. 3 is a chart showing on and off cycling data over time such as measured with a data logger.

FIG. 2 is a chart showing outside temperature data over time such as can be recorded by a data logger according to one aspect of the invention. FIG. 3 is a chart showing on and off cycling data over time such as measured with a data logger. FIGS. 2 and 3 correspond to one another showing a time period from midnight (00:00:00 A.M.) to 6:10:00 A.M. During that time period, as shown in FIG. 2, the outdoor temperature generally decreases overnight and then begins to increase at about 5 A.M. and steadily increases after that time. In FIG. 3, the on and off cycling of furnace state is shown. Note the changes in the duration that the furnace is on and off (width of cycles). When the outdoor temperature drops rapidly, this is generally followed by longer on states and/or shorter off states of the furnace.

Figure 4:
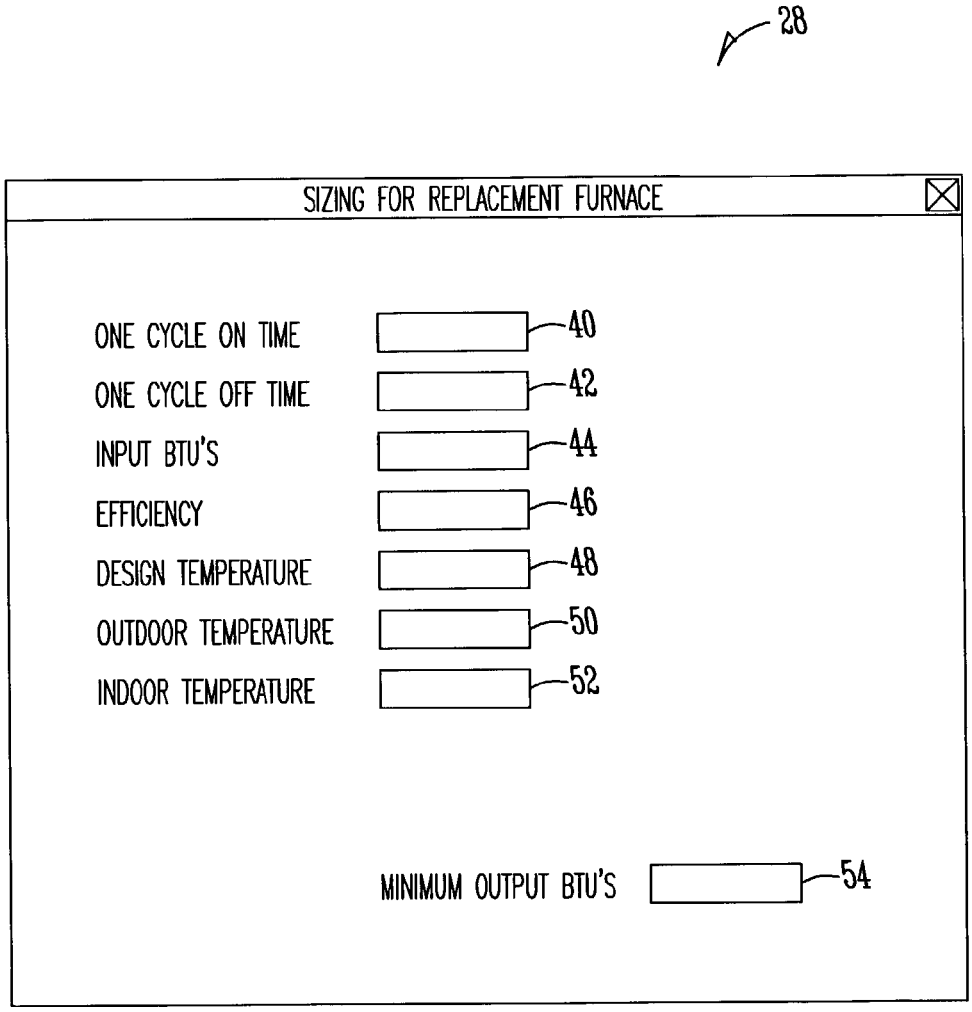
FIG. 4 is a pictorial representation of a display screen associated with an article of software according to one embodiment of the present invention.

FIG. 4 provides a pictorial representation of a computer data display 28 associated with the article of software. In FIG. 4, input data such as cycle on time 40, and cycle off time 42 are shown. In addition, input information such as input BTUs 44, efficiency 46 are shown. Also, a outdoor design temperature 48 is shown, along with outdoor temperature 50, and indoor temperature 52. Based on this and such other information, a minimum output BTUs for a minimum sizing for replacement furnace is calculated at 54.

Ideally, a properly sized furnace should run continuously on the coldest day of the year while maintaining an indoor temperature of 72° F. In order to know what size replacement furnace to install in a home, one should know the heat loss of the home on the coldest day of the year when the home is maintained at 72° F. If the furnace is running for less than 100 percent of the time when the outdoor temperature is at or below the design temperature, then the furnace is oversized. The present invention allows accurate determinations to be made as to how much over or undersized the furnace is even when the outdoor temperature is not at or below the outdoor design temperature. The basic equation can be written as:

$$(heatloss) = \left( \frac{(inputBTUHs)\cdot(efficiency)\cdot(percenton)\cdot(72^\circ\ \text{F.} - outdoordesigntemperature)}{(indoortemperature - outdoortemperature)} \right)$$

Input BTUHs "inputBTUHS" is the rated or measured input to the furnace. The input BTUHs multiplied by the efficiency results in the output of the furnace. For example, input BTUHs can be recorded from the rating plate of the existing furnace. Other methods for determining the output of the furnace can also be used. For example, the gas meter can be examined to determine how many BTUHs are flowing into the furnace. Another method, known in the art, is to measure the temperature of escaping flue gases and then calculate output of the furnace based on that measurement.

The furnace efficiency "efficiency" can be measured by taking the flue gas temperature or though other methods known in the art. Optionally, the "efficiency" of the furnace can be recorded from the rating plate of the furnace.

The percentage of time a furnace is on "percenton" is calculated from data collected from a first data logger. This first data logger is attached to the furnace and preferably overnight (or during other periods of extreme temperature conditions) records whether the burner is "on" or "off", and records the time of each "on" and "off" transition. The length of each on to off to on again cycle is readily determined from these times. The length of time the burner is on in a typical cycle divided by the total time of the cycle (time the burner is both "on" and "off") gives "the percentage of time the furnace is "on." The present invention uses one or more complete cycles.

The "actual indoor temperature" is measured at the thermostat inside the home. The indoor temperature can be measured with a temperature sensor and data logger or the thermostat temperature can be used.

The "actual outdoor temperature" is measured by a second data logger outside the home. This second data logger collects temperature as a function of time. Care must be taken to place the second data logger away from heat sources. The second data logger is left out overnight and retrieved the next morning. Information is collected at night so there is no solar effect to skew results. The "actual outdoor temperature" selected for the calculation should correspond to the same time as the furnace cycle. Data loggers are preferably used that are synchronized to the same time. For example, the time and date of each data logger can be set by the same computer such that both data loggers have the same time as the computer.

The "outdoor design temperature," based upon historical weather data, is the lowest temperature normally encountered at a given locale. 98 percent of the time, the outdoor temperature" is warmer than the outdoor design temperature. Manual J, "Residential Load Calculation," Air Conditioning Contractors of America, has a table of outdoor design temperatures for given locales. That reference is herein incorporated by reference in its entirety.

The replacement furnace should be selected to generate the calculated heat loss or slightly more.

$$(heatloss) = \left( \frac{(inputBTUHs)\cdot(efficiency)\cdot(percenton)\cdot(72^\circ\ \text{F.} - outdoordesigntemperature)}{(indoortemperature - outdoortemperature)} \right)$$

The percent that the current furnace is over or undersized can then be calculated from the "heat loss" as follows:

$$(overunder) = \frac{(inputBTUHs)\cdot(efficiency)}{(heatloss)}\cdot 100$$

If the resulting percentage is less than 100 percent than the difference between 100 percent and the calculated percentage is the percent that the furnace is undersized. If the resulting percentage is over 100 percent then the difference between the calculated percentage and 100 percent is the percent that the furnace is oversized.

The present invention provides the advantage of measuring heat loss as opposed to attempting to measure the envelope of the building.

EXAMPLE 1

This process was performed on a house in Council Bluffs, Iowa. A first data logger was attached to the furnace and recorded when the furnace burner was "on" and "off." The burner came "on" at 3:36:20 am and turned "off" at 6:40:12 am. The burner came "on" again at 6:54:16 am. This completed one "on", "off" and "on" again cycle. The total time of the cycle was 197.94 minutes. Of this time, for 183.87 minutes or 92.89% of the time, the burner was "on."

A second data logger recorded the outdoor temperature as 0.75° F. during this furnace cycle. The input BTUHs to the furnace was 42,000 BTUHs. The efficiency of the furnace, calculated from the flue temperature, was 81 percent. The indoor temperature of the house was 71° F. The design temperature for Council Bluffs, Iowa is −3° F.

The heat loss of the house=((42,000 BTUH)(0.81)(0.9289)(72° F.−(−3° F.)))/(71° F.−0.75° F.)=33,737 BTUHs.

This house needs a furnace capable of an output of 33,737 BTUHs or slightly more. If the house has a 42,000 BTUH furnace with 81 percent efficiency, than the percent of the ideal sizing of the furnace can be calculated as =(42,000 BTUH)(0.81)/(33737 BTUH)(100)=101 percent.

Therefore, this furnace is sized accurately.

EXAMPLE 2

This process was performed on a house in Bellevue, Nebr. A first data logger was attached to the furnace and recorded when the furnace burner was "on" and "off." The burner came "on" at 4:45:49 am and turned "off" at 4:53:09 am. The burner came "on" again at 5:16:24 am. This completed one "on", "off" and "on" again cycle. The total time of the cycle was 30.58 minutes. Of this time, for 7.33 minutes or 23.97% of the time, the burner was "on."

A second data logger recorded the outdoor temperature as 30.10° F. during this furnace cycle. The input BTUHs to the furnace was 70,000 BTUHs. The efficiency of the furnace, calculated from the flue temperature, was 94 percent. The indoor temperature of the house was 68° F. The design temperature for Bellevue, Nebr. is −3° F.

The heat loss of the house=((70,000 BTUH)(0.94)(0.2397))(68° F.−(−3° F.)))/(68° F.−30.10° F.)=29,547 BTUHs.

This house needs a furnace capable of an output of 29,547 BTUHs or slightly more. If the house has a 70,000 BTUH furnace with 94 percent efficiency, then the percent of the ideal sizing of the furnace can be calculated as =(70,000 BTUH)(0.94)/(29547 BTUH)(100)=223 percent. The furnace of this house is drastically oversized by 123 percent!

For purposes of these examples, only single cycles were examined. The present invention contemplates that multiple cycles can also be examined for an overnight time period or other time period. Because the data is available and the software performs the calculations, this variation is readily implemented. When multiple cycles are examined, the results of those cycles can be averaged, the cycle associated with the coldest temperatures can be used, or the longest or shortest cycle can be used. For accuracy, it is preferred that complete cycles are examined, beginning with the furnace cycling on.

The accuracy of the present invention is greatest when the outdoor temperature is at or near the outdoor design temperature. This results in the longest on cycles and minimizes the effects of supplemental heat. Supplemental heat is the heat produced in the home by things other than the heating equipment used to heat the structure. In heating applications, most of these can be considered "free" heat because they are by-products of some other function or operation independent of the furnace. All appliances and electronics add supplemental heat to a building while they are being used. For example, lighting also produces heat as a by-product; likewise electric motors create heat in the home. Even the indoor electric motors involved in air Conditioning are part of the heat load of the building. Of course, a range used to prepare a meal adds heat and even a television can output a significant amount of heat over the course of a day.

Showering or any other use of hot water adds significant heat to a building, but the largest source of supplemental heat in most buildings is solar gain. When the sun comes streaming through the windows the furnace can usually rest for awhile. All these supplementary heat sources help the furnace heat the home, but work against an air conditioner's efforts to cool the building.

Because the present invention accounts for all the BTUs that are leaving the building at any given outdoor temperature, the supplemental heat is preferably taken into account. The reason that data loggers are used to collect the data in the middle of the night is not merely because the temperatures are usually colder then, but is an effort to reduce the effects of supplemental heat production. Trying to account for solar gain during day light hours is very difficult. At night, solar gain is no longer a problem, and any occupants of a house are typically asleep and therefore less likely to be using lighting, appliances, hot water, or other sources of supplemental heat.

The present invention can compensate for the use of supplemental heat through the use of what the inventor calls the "house factor." The house factor uses the average BTU outputs from water heaters, refrigerators, freezers, 24 hour/night lights, standing pilots on ranges and gas logs, and the average number of people and pets that live in the home. The present invention uses this expected house factor so that it need not be calculated individually for every house. Because supplemental heat production is about the same in most homes the size of the home determines what percentage it is of total heat loss. The supplemental heat becomes a smaller percentage of the buildings total heat requirements as the outdoor temperature grows colder. Therefore, according to the methodology of the present invention, the supplemental heat compensation is reduced until the outdoor temperature reaches the outdoor design temperature. At this point and lower, there is no longer any need for compensating for supplemental heat and no effect on proper sizing.

Although the present invention preferably uses a normal standard for the supplemental heat present in the home based on the size of the home, the installer of the data logger needs to be aware of unusual sources of supplemental heat that can have significant effects on the amount of supplemental heat present. Large fish tanks, indoor hot tubs, large numbers of animals or people, small room/space heaters, and equipment usually not found in a residential setting. If an unusual source of supplemental heat is found, its BTU output per hour needs to be determined and that value added to the furnace size prediction.

As an example of how supplemental heat is compensated for, the following equation provides:

$$(heatloss) = \left( \frac{(inputBTUHs)\cdot(efficiency)\cdot(percenton)\cdot (72^\circ\ \mathrm{F.} - outdoordesigntemperature)}{(indoortemperature - outdoortemperature - housefactor)} \right)$$

The higher the temperature (further from design temperature), the larger the house factor becomes to compensate for the heightened effect on the results. Essentially, the house factor is the number of degrees of heating contributed by heat sources other than the furnace. Some of these heat sources may not always be present and should therefore be discounted in determining the size of the furnace. Typically, a house factor of 0 to 9 can be used, based primarily on outside temperature and house size. The smaller the house, the larger the house factor. The higher the outside temperature, the higher the house factor. Thus, the larger the house, typically the reduced importance of the house factor.

Instead of using a temperature offset, the actual BTUHs can be used if known for the heat sources. Because the present invention monitors cycling, false cycling can also be identified. A furnace is false cycling if it is not cycling with the thermostat. This can be determined via software, or by comparing the graphs of FIGS. 2 and 3. The cause of false cycling can be problems with flame sensors, dirty filters, mechanical failures, a restricted duct system, gas valve regulator failure, or other anomalies. Because complete data is recorded, these problems can also be identified and resolved.

The present invention contemplates multiple uses and applications. Because the size of a furnace can be determined experimentally by examining the heat envelope, and because of the convenient use of the data loggers to provide for accurate and complete data, the system and method of the present invention allow an inspector who is inspecting HVAC installations to determine the percent over or undersized the HVAC equipment is. This allows for code enforcement or regulation of the industry in a manner that has previously been unavailable. Thus, contractors can be required to appropriately size HVAC equipment and their work can be monitored. In addition, contractors will be able to warrant that the furnace is appropriately sized.

Another use of the present invention relates to determining the effect of changes in the structure of the home on heating and cooling. For example, the methodology of the present invention can be used to determine the ideal furnace size prior to the installation of insulation and after the installation of insulation. Comparing the furnace size needed before and after adding the insulation provides a measure of how the addition of the insulation affects the efficiency of the home. This objective measure would be useful in the context of promoting sales for insulation, windows, doors, and other products for the purpose of saving heating costs because it can be used to quantify the reduction in heating required which can then be translated into dollars saved.

The present invention further provides that the data loggers can, instead of or in addition to storing data locally, transmit the data remotely through any number of various communication channels (i.e. cellular communication or other RF transmissions or wired communication, such as telephone land line or network channel). The present invention contemplates that the data logger can be built-in to the HVAC equipment for this purpose.

Although the present invention is described primarily in terms of a furnace the present invention contemplates that sizing of other types of HVAC equipment, including air conditioners can be performed according to the present invention. In such an application of the methodology of the present invention, the "outdoor design temperature," based upon historical weather data, would be the highest temperature normally encountered at a given locale. 98 percent of the time, the outdoor temperature" is colder than the outdoor design temperature.

Therefore, a method and system for measuring heat loss from a home has been disclosed that can be used to determine the proper sizing for HVAC equipment. The present invention contemplates numerous variations and embodiments within the spirit and scope of the invention.

What is claimed:

1. A method for determining proper size of HVAC equipment using load measurement, comprising:

recording on and off cycling data associated with equipment associated with a structure for a period of time;

recording inside temperature data of the structure for the period of time;

recording outside temperature data outside of the structure for the period of time;

selecting one complete cycle from the on and off cycling data of the HVAC equipment, wherein each complete cycle is defined as a cycle beginning when the HVAC equipment turns to an on state and which continues as the HVAC equipment remains in the on state and then turns to an off state and remains in the off state with the cycle ending when the HVAC equipment turns to the on state again, each change of state triggered by the thermostat;

determining a total time from the on and off cycling data for the one complete cycle;

determining a percentage of the total time during which the HVAC equipment was on from the on and off cycling data for the one complete cycle;

determining a heat loss based on load measurement from characteristics of the HVAC equipment, an outdoor design temperature, the inside temperature data, and the outside temperature data and determining a minimum size of the HVAC equipment needed to maintain a desired internal temperature at least partially based on the outdoor design temperature, the heat loss based on load measurement, efficiency of the HVAC equipment, and the percentage of the total time during which the HVAC equipment was on from the on and off cycling data for the one complete cycle.

2. The method of claim 1 wherein the HVAC equipment includes a furnace.

3. The method of claim 1 wherein the step of recording on and off cycling data being performed with a first data logger operatively connected to the HVAC equipment and wherein the first data logger is adapted for recording a time of each change of state of the HVAC equipment.

4. The method of claim 3 further comprising downloading the on and off cycling data from the first data logger to a computer.

5. The method of claim 1 wherein the step of recording outside temperature data being performed with a second data logger and wherein the second data logger is adapted for recording a time associated with each recorded outside temperature.

6. The method of claim 1 wherein the step of recording inside temperature data being performed with a third data logger operatively connected to a thermostat within the structure and wherein the third data logger is adapted for recording a time associated with each recorded inside temperature.

7. The method of claim 1 wherein the step of determining a minimum size of the HVAC equipment being performed by software.

8. The method of claim 1 further comprising calculating a percentage of over/under sizing of the HVAC equipment.

9. The method of claim 1 wherein the step of determining the minimum size of the HVAC equipment needed to maintain the desired internal temperature includes compensating for supplemental heat.

10. A method for determining heat loss of a building and sizing a furnace having a burner based on load measurement of heat loss, comprising:

setting a thermostat associated with the furnace to a desired indoor temperature;

recording on and off cycling data of at least one cycle associated with the furnace of the building for a period of time, the on and off cycling data including a time the furnace cycles on, a time the furnace cycles off, and a time the furnace cycles on again;

recording outside temperature data outside of the building for the period of time;

synchronizing the outside temperature data with the on and off cycling data;

determining a total time period for at least one complete on/off cycles from the on and off cycling data, wherein each complete cycle is defined as a cycle beginning when the burner turns to an on state and which continues as the burner remains in the on state and then turns to an off state and remains in the off state with the cycle ending when the burner turns to the on state again, each change of state triggered by the thermostat;

determining a percentage of the total time during which the burner was on from the on and off cycling data;

determining a heat loss based on load measurement from the characteristics of the furnace, an outdoor design temperature, the inside temperature data, and the outside temperature data, determining a minimum size of the furnace needed to maintain the desired internal temperature at least partially based on the outdoor design temperature, the heat loss based on load measurement and the percentage of the total time during which the burner was on from the on and off cycling data for the one complete cycle.

11. The method of claim 10 wherein the furnace is a variable speed furnace.

12. The method of claim 10 wherein the step of determining is performed by software.

13. The method of claim 10 wherein the step of recording on and off cycling data is performed by a data logger.

14. The method of claim 10 further comprising replacing the furnace with a second furnace of at least the minimum size.

15. The method of claim 1 wherein the step of determining a minimum size of the HVAC equipment needed to maintain a desired internal temperature is further at least partially based on a second complete cycle from the on and off cycling data.

16. The method of claim 10 wherein the step of determining a minimum size of the furnace needed to maintain the desired internal temperature is further at least partially based on a second complete cycle from the on and off cycling data.

* * * * *